US009260219B2

(12) United States Patent
Sommer

(10) Patent No.: US 9,260,219 B2
(45) Date of Patent: Feb. 16, 2016

(54) MULTI-LEVEL BAKERY TRAY

(71) Applicant: Monoflo International, Inc., Winchester, VA (US)

(72) Inventor: Axel Sommer, Tacoma, WA (US)

(73) Assignee: MONOFLO INTERNATIONAL, INC., Winchester, VA (US)

( * ) Notice: Subject to any disclaimer, the term of this patent is extended or adjusted under 35 U.S.C. 154(b) by 134 days.

(21) Appl. No.: 13/835,279

(22) Filed: Mar. 15, 2013

(65) Prior Publication Data

US 2014/0262910 A1 Sep. 18, 2014

Related U.S. Application Data

(60) Provisional application No. 61/732,575, filed on Dec. 3, 2012.

(51) Int. Cl.

| | |
|---|---|
| ***B65D 21/032*** | (2006.01) |
| ***B65D 85/62*** | (2006.01) |
| ***B65D 21/02*** | (2006.01) |

(52) U.S. Cl.

CPC ..... *B65D 21/0216* (2013.01); *B65D 21/0213* (2013.01)

(58) Field of Classification Search

CPC ... B65D 21/045; B65D 25/205; B65D 21/046

USPC ..... 206/503–509, 511–512, 449

See application file for complete search history.

(56) References Cited

U.S. PATENT DOCUMENTS

| | | | |
|---|---|---|---|
| 3,113,680 | A | 12/1963 | Frater |
| 3,404,804 | A | 10/1968 | Frater |
| 3,934,724 | A | 1/1976 | Johnson |
| 4,000,817 | A | 1/1977 | Sanders et al. |
| 4,007,839 | A | 2/1977 | Stahl |
| 4,093,071 | A | 6/1978 | Stahl et al. |
| 4,102,453 | A | 7/1978 | Carroll et al. |
| 4,106,623 | A | 8/1978 | Carroll et al. |
| 4,106,624 | A | 8/1978 | Thurman |
| 4,189,052 | A | 2/1980 | Carroll et al. |
| 4,308,954 | A | 1/1982 | Wilson |
| 4,334,616 | A | 6/1982 | Wilson |
| 4,379,508 | A | 4/1983 | Miller et al. |
| 4,383,611 | A | 5/1983 | Kreeger |
| 4,402,408 | A | 9/1983 | Kreeger et al. |
| 4,426,001 | A | 1/1984 | Stahl et al. |

(Continued)

FOREIGN PATENT DOCUMENTS

| | | |
|---|---|---|
| CA | 2276863 | 2/2000 |
| WO | WO 98/18687 | 5/1998 |

*Primary Examiner* — Chun Cheung

(74) *Attorney, Agent, or Firm* — Nixon & Vanderhye P.C.

(57) ABSTRACT

A bakery tray includes a base member with a front end and a back end, and a pair of sidewalls extending upward from the base member and opposing each other between the front end and the back end of the base member. The sidewalls each have a pair of stacking blocks and a top rail with a pair of low stack recesses therein. The pair of stacking blocks includes a front block positioned a first distance from the front end and a rear block positioned a second distance from the back end. The pair of low stack recesses includes a front recess spaced from the front end by a distance corresponding to the second distance and a rear recess spaced from the back end by a distance corresponding to the first distance. By this structure, bakery trays are stackable in a low stack orientation and a high stack orientation.

11 Claims, 16 Drawing Sheets

(56) References Cited

U.S. PATENT DOCUMENTS

| | | | | |
|---|---|---|---|---|
| 4,441,615 | A | 4/1984 | Goodrich | |
| 4,523,681 | A | 6/1985 | Kreeger | |
| 4,570,798 | A | 2/1986 | Wilson | |
| 4,577,759 | A | 3/1986 | Kreeger | |
| 4,600,103 | A | 7/1986 | Tabler | |
| 4,619,366 | A | 10/1986 | Kreeger | |
| 4,671,411 | A | 6/1987 | Rehrig et al. | |
| 4,842,142 | A | 6/1989 | Kreeger | |
| 4,936,458 | A | 6/1990 | Tabler et al. | |
| 4,960,207 | A * | 10/1990 | Tabler et al. | 206/507 |
| 4,982,844 | A | 1/1991 | Madan et al. | |
| 5,035,326 | A | 7/1991 | Stahl | |
| 5,287,966 | A | 2/1994 | Stahl | |
| 5,582,296 | A | 12/1996 | Beauchamp et al. | |
| 5,881,902 | A | 3/1999 | Ackermann | |
| 5,896,992 | A | 4/1999 | McGrath | |
| 6,273,259 | B1 | 8/2001 | Stahl | |
| 6,557,718 | B1 | 5/2003 | Cesano | |
| 7,686,167 | B1 * | 3/2010 | Stahl | 206/507 |
| 2001/0029874 | A1 | 10/2001 | Muirhead | |
| 2003/0183549 | A1 * | 10/2003 | Verna et al. | 206/509 |
| 2008/0110790 | A1 * | 5/2008 | McTavish et al. | 206/511 |
| 2012/0211390 | A1 * | 8/2012 | Hassell et al. | 206/510 |

* cited by examiner

MULTI-LEVEL BAKERY TRAY

CROSS-REFERENCES TO RELATED APPLICATIONS

This application claims the benefit of U.S. Provisional Patent Application Ser. No. 61/732,575, filed Dec. 3, 2012, the entire content of which is herein incorporated by reference.

STATEMENT REGARDING FEDERALLY SPONSORED RESEARCH OR DEVELOPMENT (Not Applicable)

BACKGROUND OF THE INVENTION

The invention relates to a bakery tray and, more particularly, to a bakery tray that is stackable in different levels depending on an orientation of an adjacent tray.

Injection molded trays stackable in multiple levels are known. Such trays are typically well-suited for bakery items such as buns and muffins and the like. Depending on the product in the tray, for storage and transport, the trays may be stacked in a high stack orientation, which maximizes the space between the trays, and a low stack orientation, which reduces the space between the trays (e.g., for narrower products) and consequently minimizes a stack height to accommodate more product.

Stacking or destacking the bakery trays can be problematic, particularly as a height of the stack is above a stock person's shoulder level (so-called, "blind" stacking). Additionally, existing trays may not provide for destacking in multiple directions or for smooth destacking without the use of a fulcrum (lever action) from the low stack orientation. It would be desirable to provide a multi-level bakery tray where blind stacking and destacking is made easier.

BRIEF SUMMARY OF THE INVENTION

The bakery tray according to preferred embodiments of the invention provides for secure multi-level stacking while facilitating blind stacking/destacking and providing for stacking in multiple directions. Multi-level stacking is accomplished by rotating the tray 180°. In a high stack orientation, common sides of adjacent trays are aligned so that stacking blocks of adjacent trays are engaged and supported on each other. In a low stack orientation, the adjacent tray is rotated 180°, and the stacking blocks are positioned to engage low stack recesses in the tray side walls. Regardless of the high stack or low stack orientation, trays are easily destacked in either direction.

In an exemplary embodiment, a bakery tray includes a base member with a front end and a back end, and a pair of sidewalls extending upward from the base member and opposing each other between the front end and the back end of the base member. The sidewalls each have a pair of stacking blocks and a top rail with a pair of low stack recesses therein. The pair of stacking blocks includes a front block positioned a first distance from the front end and a rear block positioned a second distance from the back end, where the second distance is different from the first distance. The pair of low stack recesses includes a front recess spaced from the front end by a distance corresponding to the second distance and a rear recess spaced from the back end by a distance corresponding to the first distance.

The front recess may include a first slide wall angled from a deepest point in the front recess to the top rail toward the back end, and the rear recess may include a second slide wall angled from a deepest point in the rear recess to the top rail toward the front end. In this context, each of the sidewalls may include corner posts at respective ends of the top rails, where bottom corners of the sidewalls have cutouts cooperable with the corner posts. The first slide wall may be provided with two steps including the deepest point in the front recess and a first inclined ramp to a landing portion as a first step, and a second inclined ramp from the landing portion to the top rail as a second step. In one arrangement, the landing portion is adjacent the front block.

The rear recesses may include a vertical guide wall that defines respective support spaces for receiving stacking blocks of an adjacent bakery tray. In this context, the front blocks may have a narrower footprint than the rear blocks such that the front blocks fit in the support spaces while the rear blocks are too big to fit in the support spaces.

The front recesses may be open recesses with no sidewalls.

In another exemplary embodiment, a bakery tray is stackable on an adjacent bakery tray. The bakery tray includes a base member with a front end and a back end, and a pair of sidewalls extending upward from the base member and opposing each other between the front end and the back end of the base member. The sidewalls each have a pair of stacking blocks and a top rail with a pair of low stack recesses therein. The pair of stacking blocks includes a front block positioned a first distance from the front end and a rear block positioned a second distance from the back end, where the second distance is different from the first distance. The pair of low stack recesses includes a front recess spaced from the front end by a distance corresponding to the second distance and a rear recess spaced from the back end by a distance corresponding to the first distance. The bakery tray may be configured such that the bakery tray is stackable on an adjacent bakery tray of identical construction. Specifically, the bakery tray and the adjacent bakery tray may be stackable in a high stack position and a low stack position, where in the high stack position, the front and rear blocks are stackable in alignment with corresponding front and rear blocks of the adjacent bakery tray, and in the low stack position, the front blocks are stackable in alignment with the rear recesses and the rear blocks are stackable in alignment with the front recesses. In the high stack position, the bakery tray may be oriented in alignment with the adjacent bakery tray, and in the low stack position, the bakery tray may be oriented 180° relative to the adjacent bakery tray.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
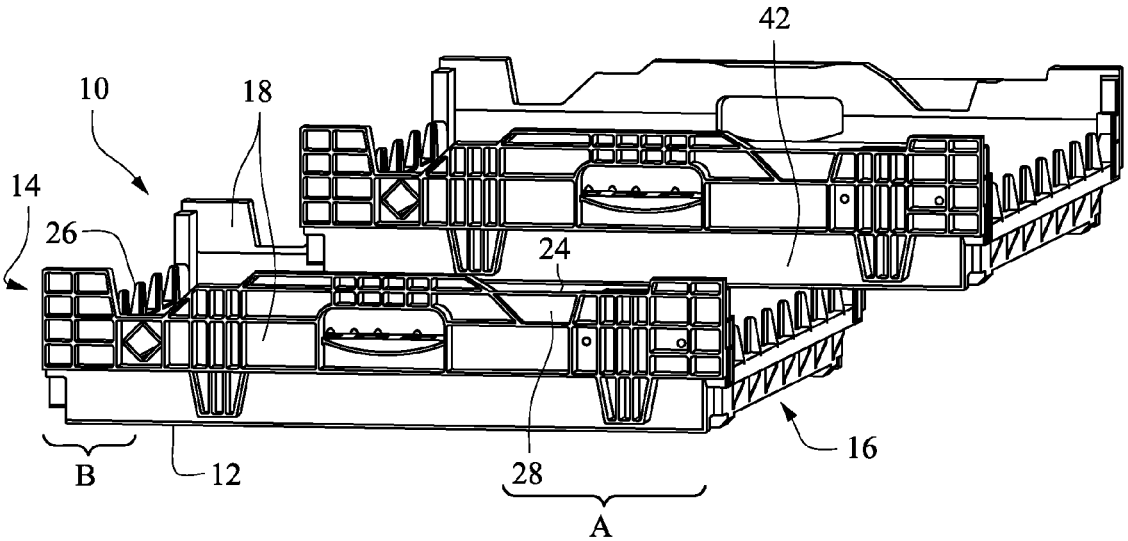
FIGS. 1-5 show details of the tray in a high stack orientation with an adjacent tray being stacked from the right.
Figure 2:
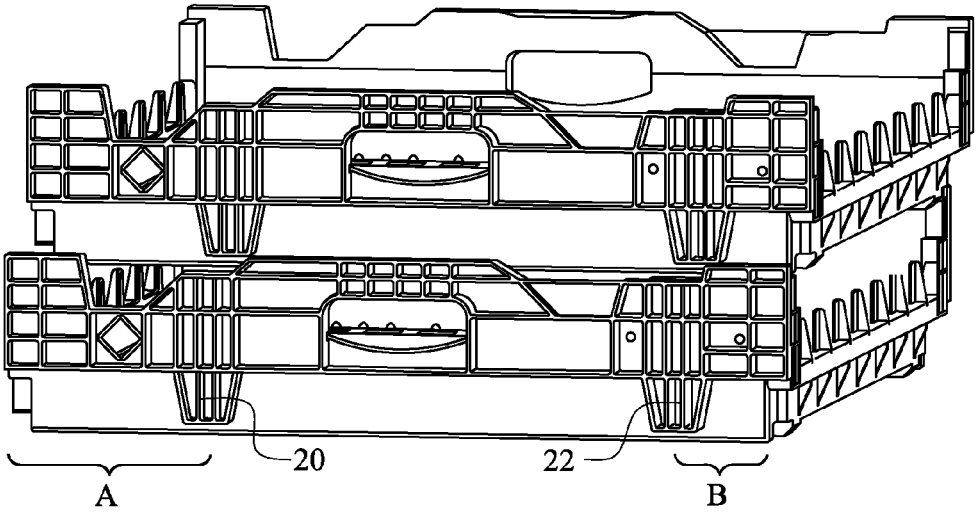
Figure 3:
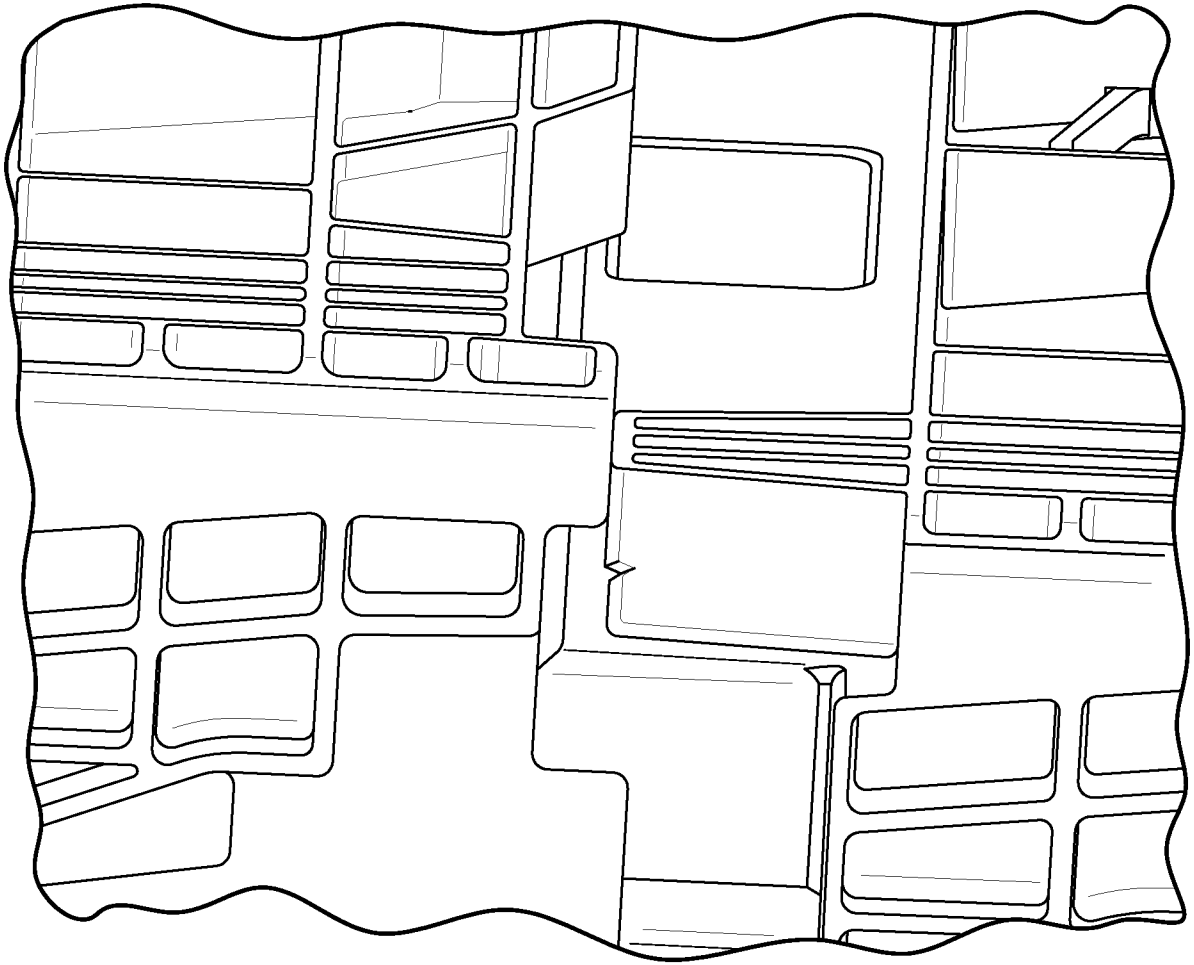

With reference to the drawings, the bakery tray 10 according to preferred embodiments, includes a front end 14 and a back end 16. The "front" and "back" are referenced solely for purposes of this description as the tray can be supported in various orientations, and neither side is effectively a "front" or "back." A pair of side walls 18 extend upward from the base member 12 and oppose each other as shown between the front end 14 and the back end 16 of the base member 12. The side walls 18 each have a pair of stacking blocks 20, 22 including a front block 20 and a rear block 22. As noted, the "front" and "rear" are defined as such relative to the arbitrary "front end" 14 and "back end" 16 of the base member 12 for purposes of this description. The front block 20 is positioned a first distance A from the front end 14, and the rear block 22 is positioned a second distance B from the back end 16. As shown, the second distance B is different from the first distance A. Specifically, A is larger than B as shown, whereby the front block 20 is positioned farther from the front end 14 than the rear block 22 is positioned from the back end 16.

Figure 4:
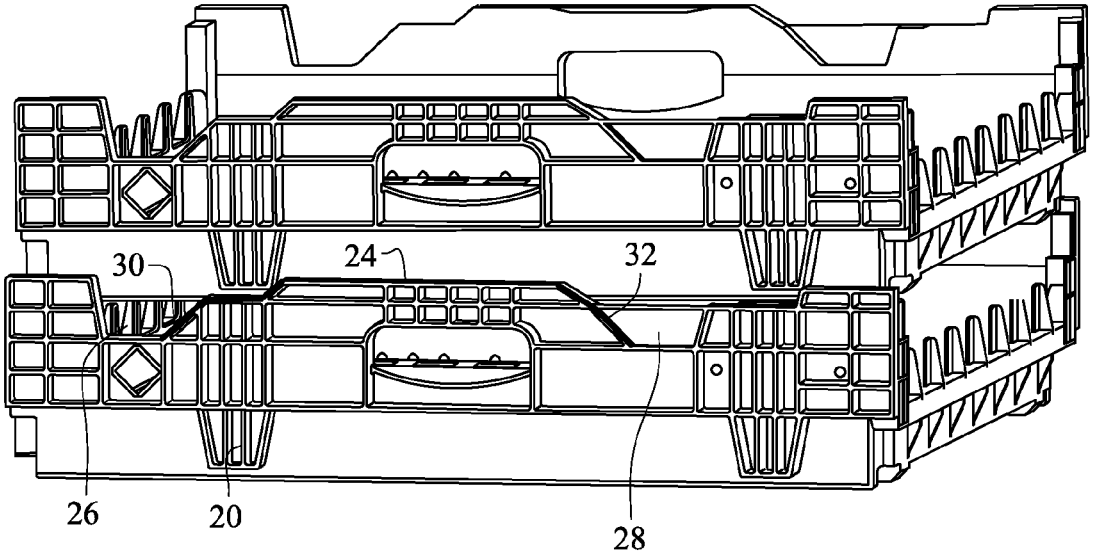

The side walls 18 also include a top rail 24, which includes a pair of low stack recesses 26, 28 therein. The low stack recesses include a front recess 26 that is spaced from the front end 14 by a distance corresponding to the second distance B and a rear recess 28 spaced from the back end by a distance corresponding to the first distance A. As highlighted in FIG. 4, the front recess 26 includes a first slide wall 30 that is angled/inclined from a deepest point in the recess 26 to the top rail 24 in the direction of the back end 16 of the base member 12. The rear recess 28 includes a second slide wall 32 that is angled/inclined from a deepest point in the rear recess 28 to the top rail 24 toward the front end 14 of the base member 12. In one exemplary construction, the first slide wall 30 is provided in two steps including the deepest point in the front recess 26 and a first inclined ramp to a landing portion as a first step, and a second inclined ramp from the landing portion to the top rail as a second step. As shown, the landing portion of the first slide wall 30 corresponds to a portion of the top rail that is adjacent the front block 20.

Figure 5:
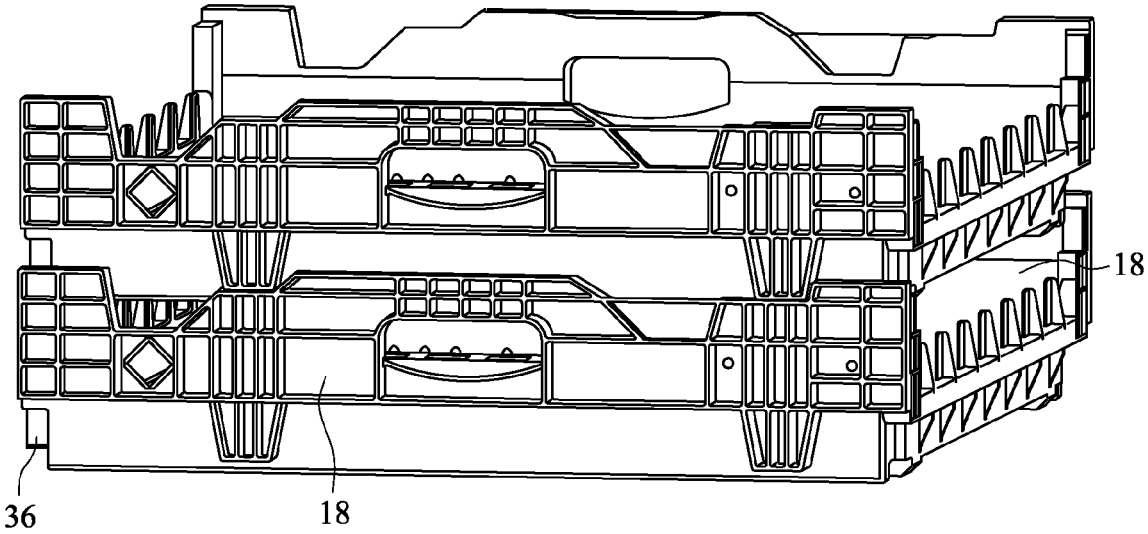
Figure 6:
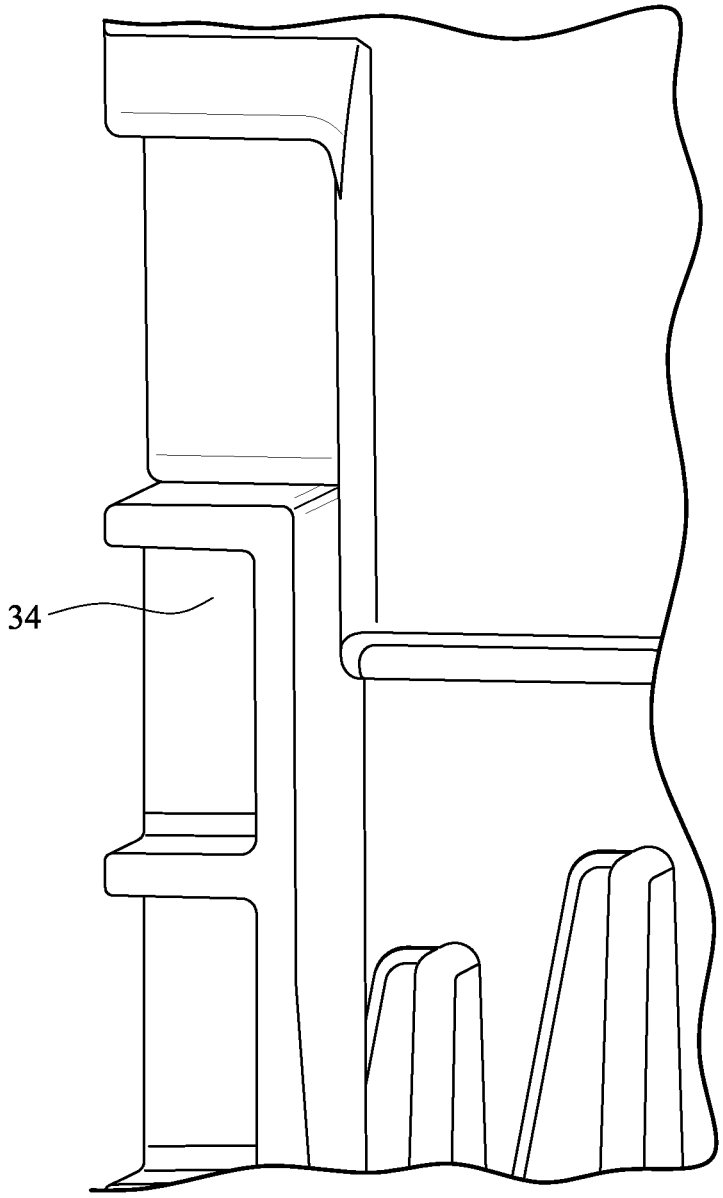
FIG. 6 is a detailed view showing the corner post support.
Figure 7:
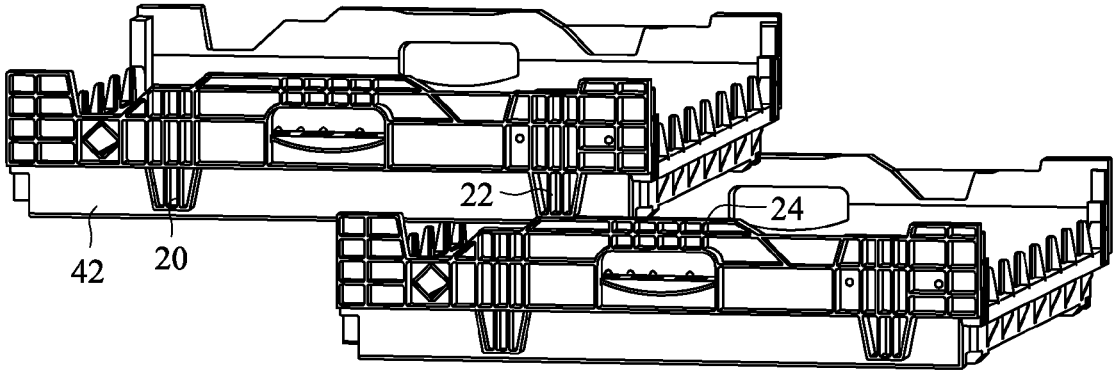
FIGS. 7-11 show the trays in the high stack orientation with an adjacent tray being stacked from the left.

With reference to FIGS. 5 and 6, each of the side walls includes corner posts 34 at respective ends of the top rails 24. Bottom corners of the side walls 18 include cutouts 36 cooperable with the corner posts.

Figure 18:
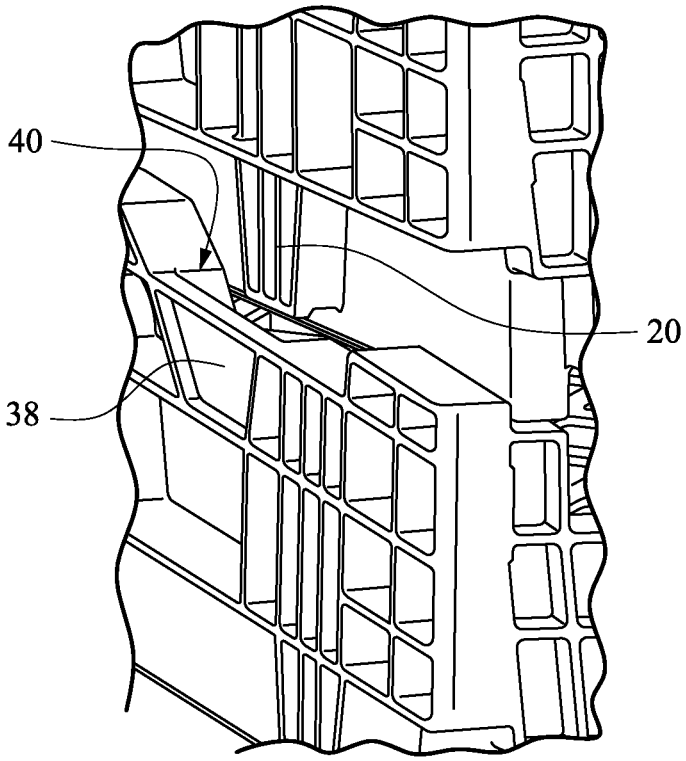
Figure 19:
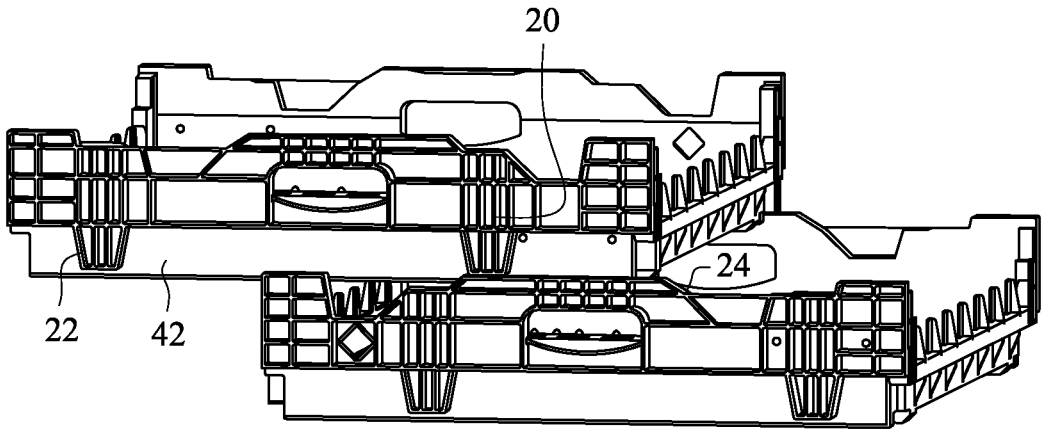
FIGS. 19-23 show the trays in the low stack orientation with an adjacent tray being stacked from the left.
Figure 20:
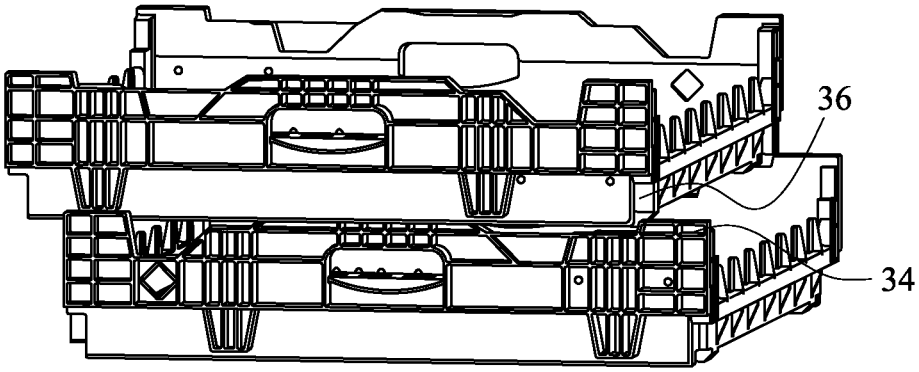
Figure 21:
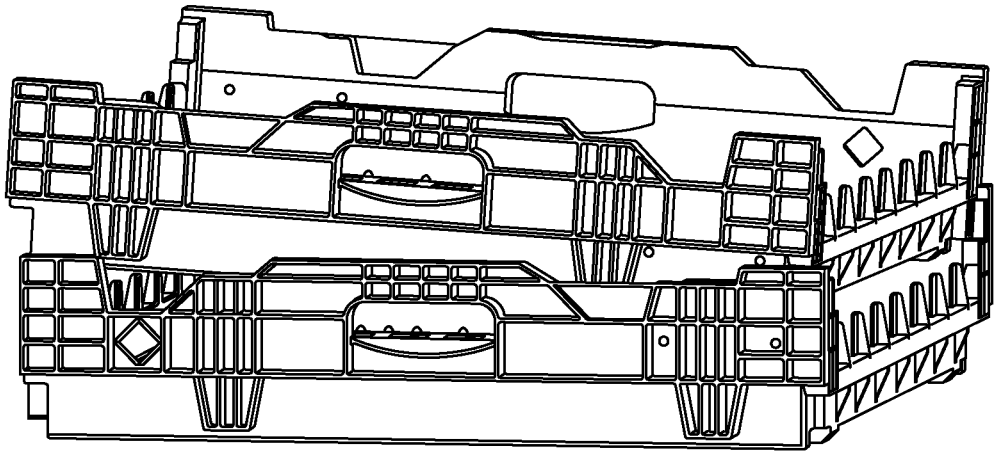
Figure 22:
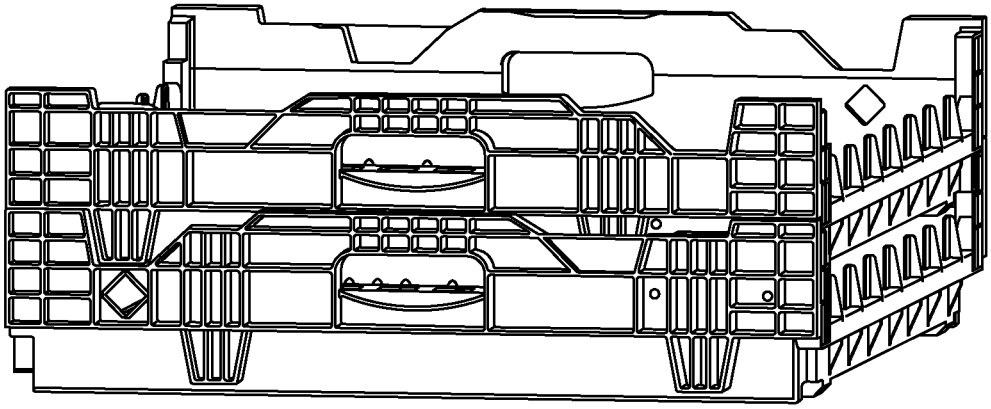
Figure 23:
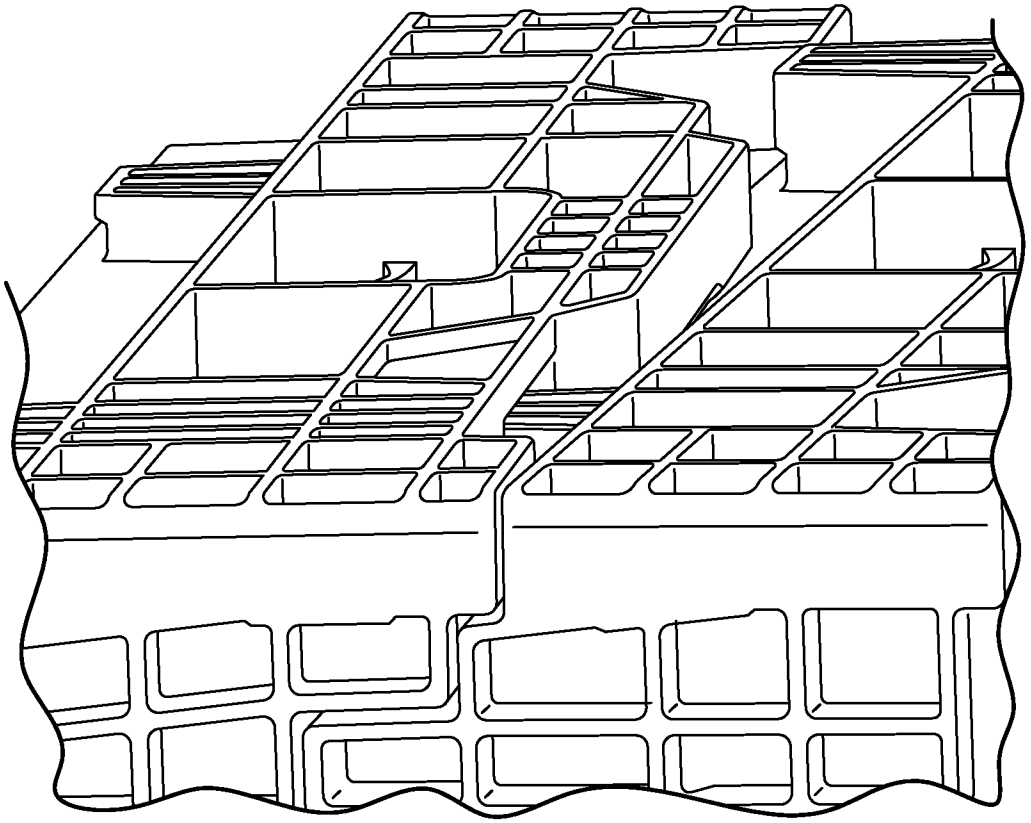
Figure 24:
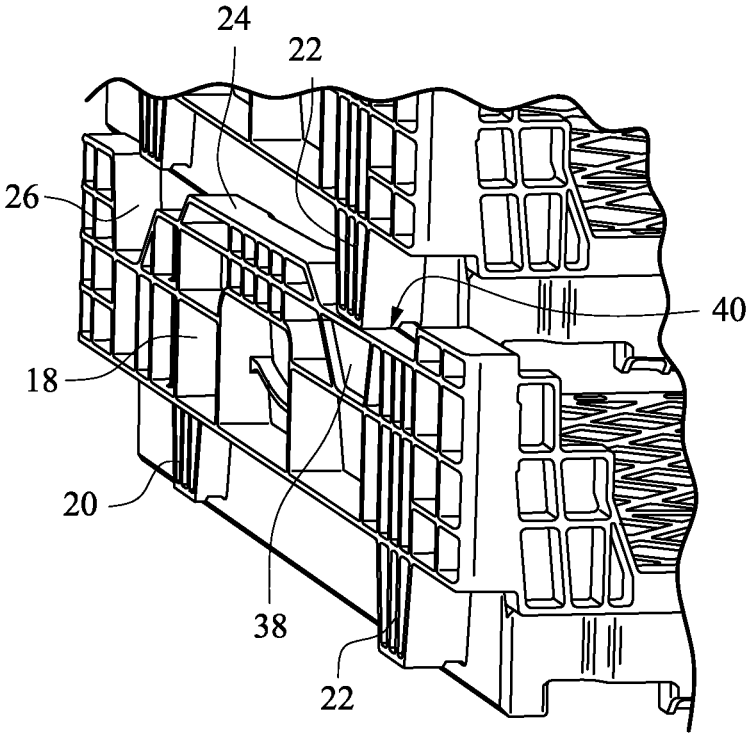
FIGS. 24-26 show details of the supporting structure for adjacent trays.
Figure 25:
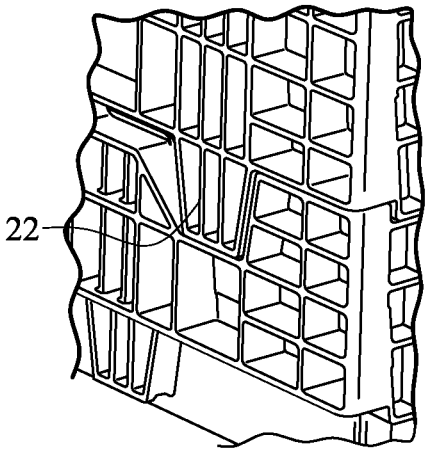

Additional details of the construction facilitate stacking of the tray and destacking in either direction. With reference to FIG. 24, the front blocks 20 have a narrower footprint than the rear blocks 22. That is, the rear blocks 22 protrude outward from the side wall in a direction perpendicular to the side wall 18 by a greater amount than the front blocks 20. Additionally, the rear recesses 28 are provided with a vertical guide wall 38 that defines a support space 40 for receiving a front block 20 of an adjacent bakery tray in the low stack position. As discussed in more detail below, FIG. 18 shows an adjacent bakery tray oriented in a low stack position, where the narrower front block 20 nests in the support space 40 adjacent the vertical guide wall 38. In contrast, in the high stack orientation shown in FIG. 24, the rear block 22 of the adjacent tray has a wider footprint and is thus too big to fit in the support space 40. As a consequence, in the high stack orientation, as an adjacent tray is slide into a nested position, the rear block engages a top of the vertical guide wall 38, which forms part of the top rail 24. The front recesses 26, in contrast, are open recesses with no side walls. In the low stack orientation shown in FIG. 25, the rear blocks 22 nest fully in the front recesses 26.

FIGS. 1, 2, 4 and 5 show an adjacent tray being slid on a tray stack in the high stack orientation from the right side in the drawings. With the trays at least partially aligned, the front blocks 20 are set on the top rails 24 of the side walls 18. The side walls include skirt portions 42 that fit inside the side walls 18 and top rail 24 and facilitate alignment of the adjacent tray. As the adjacent tray is slid back into the fully nested position, the stacking blocks 20, 22 are supported on the top rail 24. As the corner cutouts 36 nest with the corner posts 34, the front blocks 20 of the trays fall into alignment, and the adjacent tray is supported securely in the high stack orientation (see FIG. 5).

Figure 8:
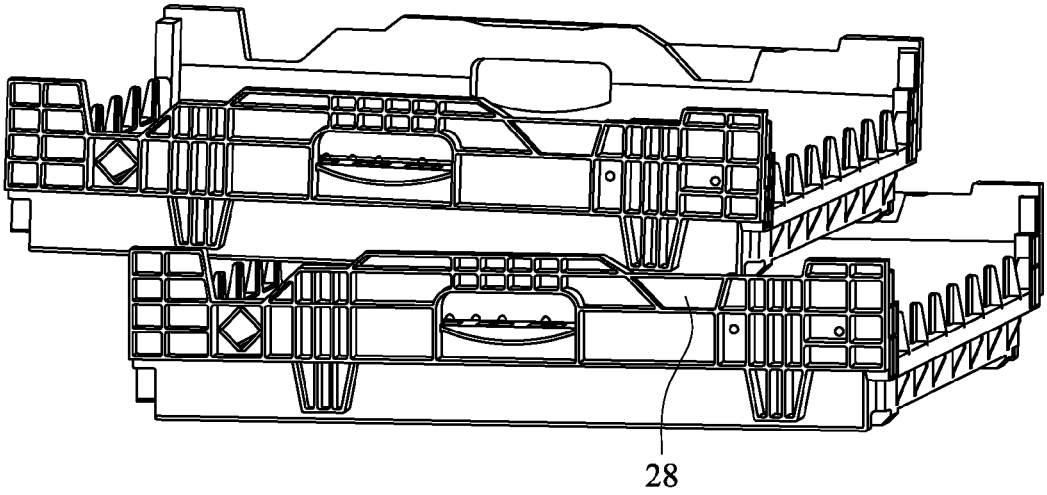
Figure 9:
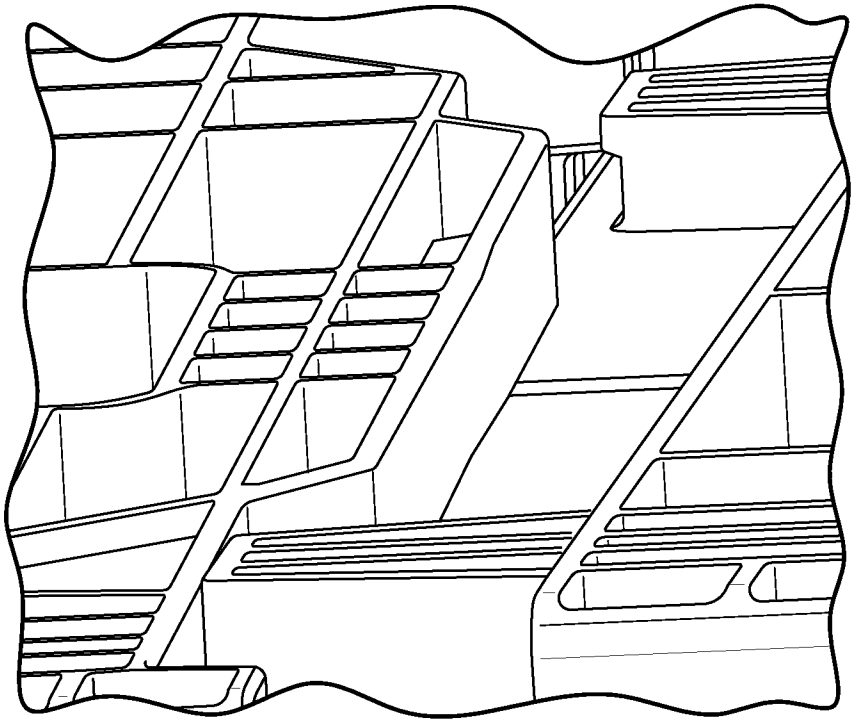
Figure 10:
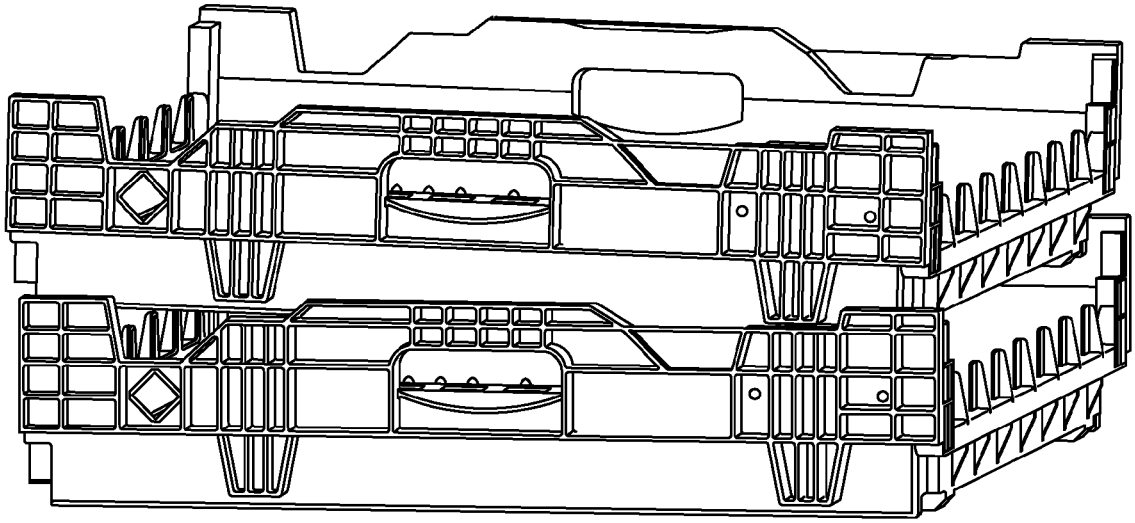
Figure 11:
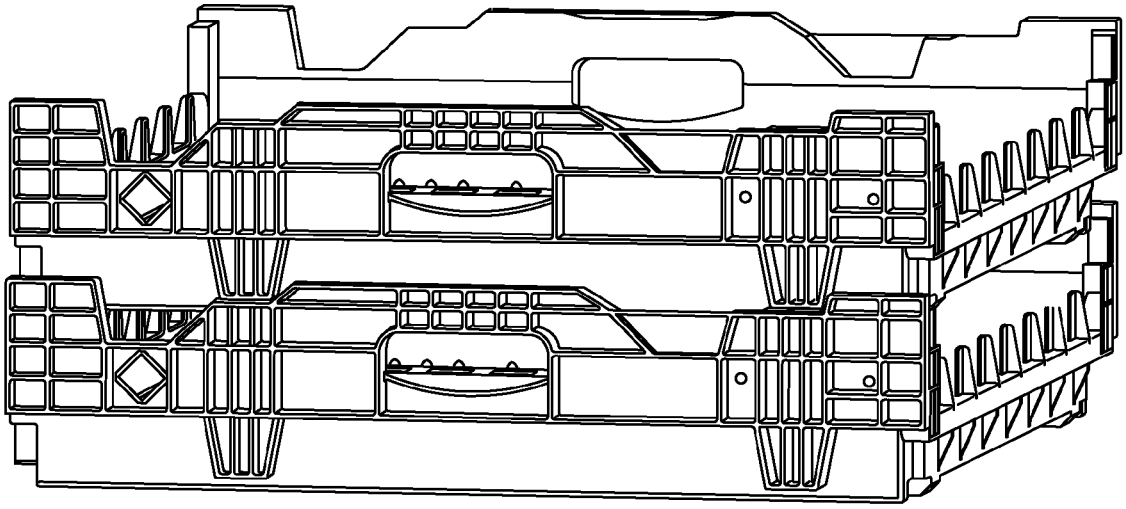
Figure 12:
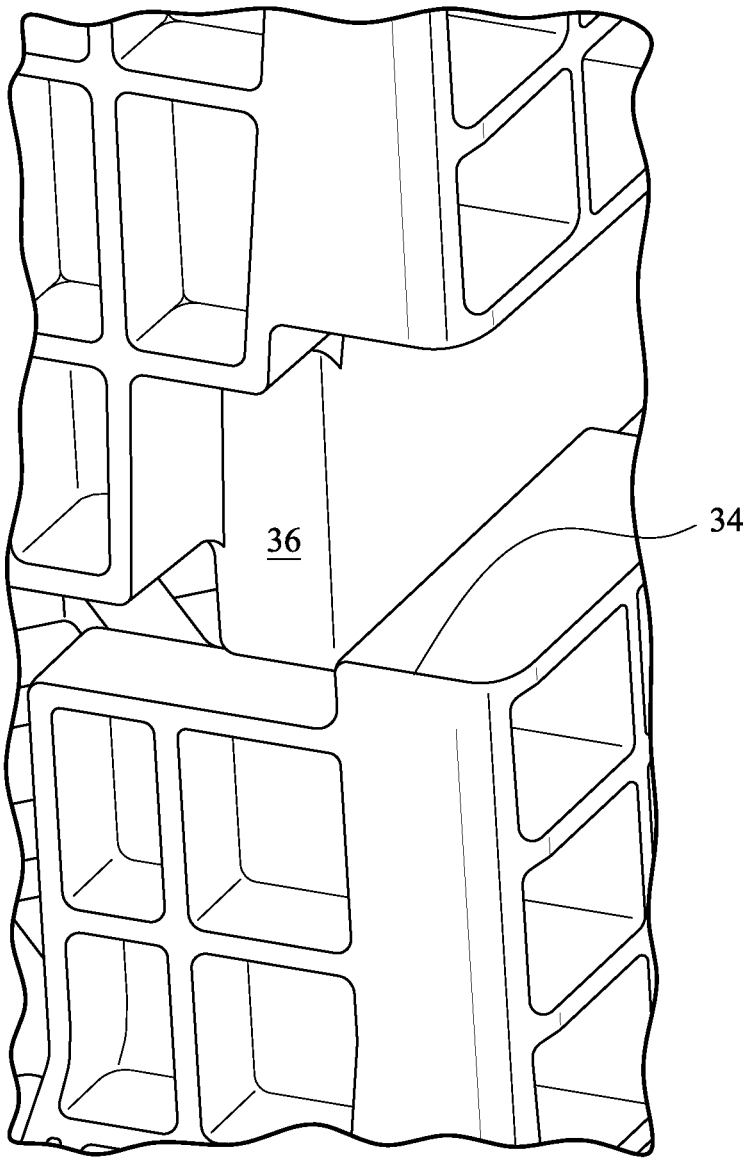
FIG. 12 is a detailed view of the corner support.

FIGS. 7-12 show an adjacent tray being slid into the high stack orientation from the opposite direction (left side in the drawings). The adjacent tray is initially and preliminarily aligned via the skirt 42, and the stacking blocks 20, 22 engage the top rail 24. As shown in FIGS. 8, 9 and 24, as the rear block 22 is slid over the rear recess 28, the rear block 22 is supported on top of the guide wall 38, without dropping into the support space 40 (due to the footprint of the rear block 22). The adjacent tray reaches the fully nested position when the corner cutout 36 engages the corner post 34 of the bottom tray (see FIGS. 10-12). In the high stack orientation shown in FIGS. 5 and 11, a space between adjacent trays is maximized.

Figure 13:
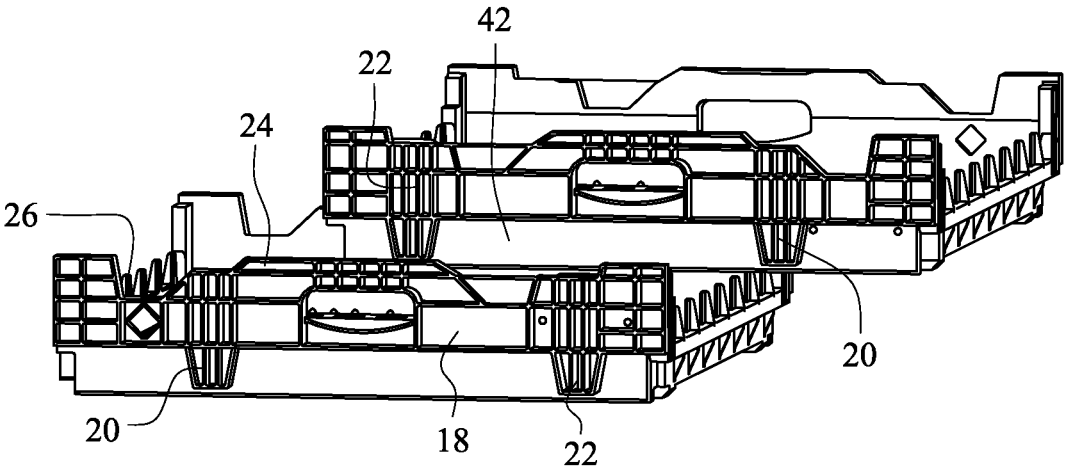
FIGS. 13-18 show the trays in a low stack orientation with an adjacent tray being stacked from the right.
Figure 14:
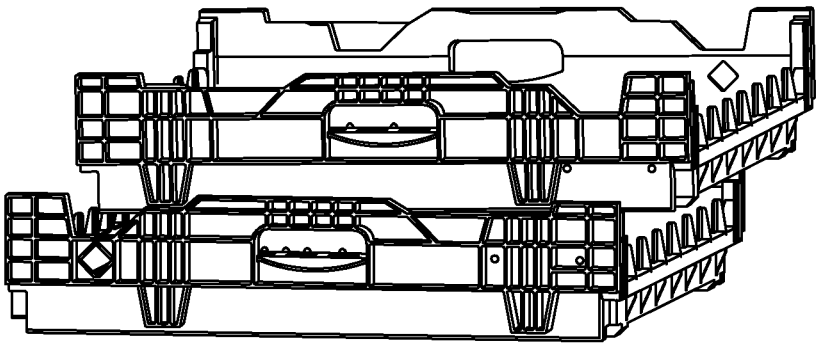
Figure 15:
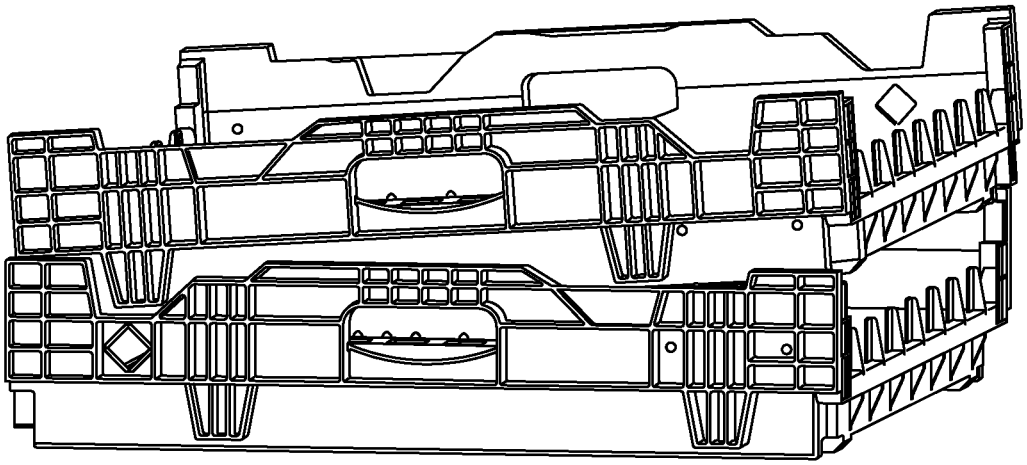
Figure 16:
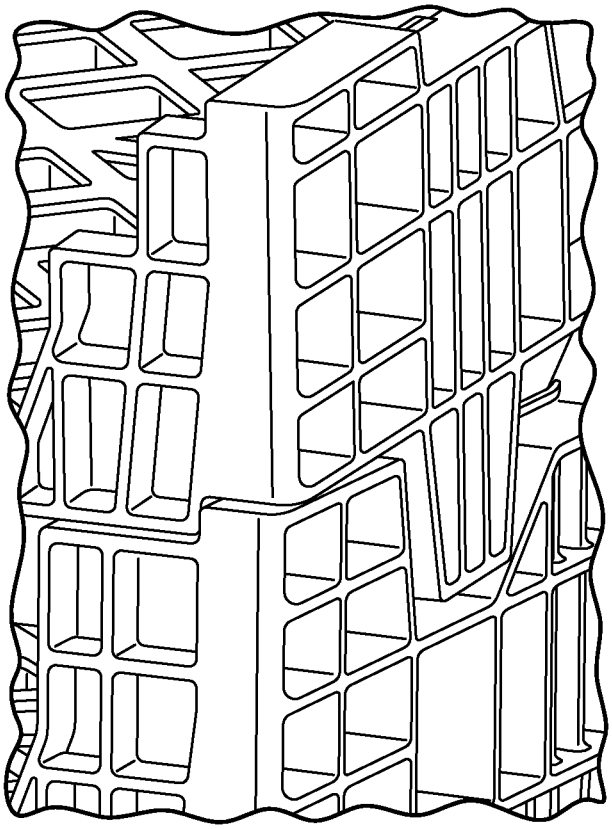
Figure 17:
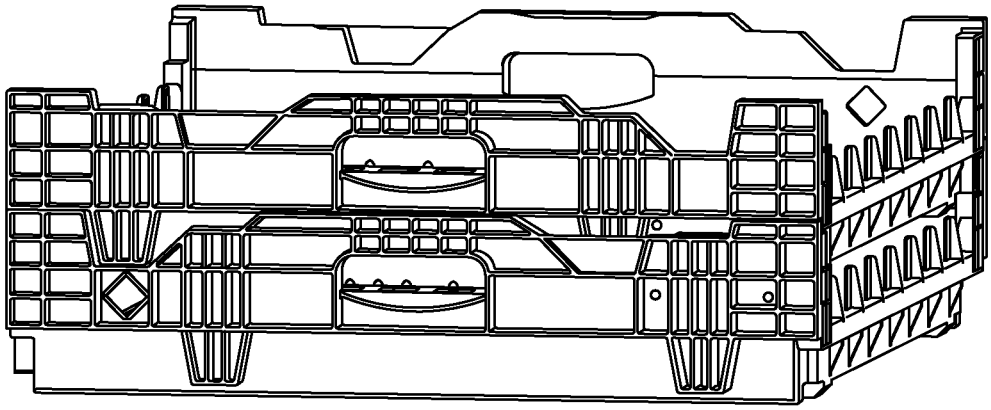

FIGS. 13-18 show an adjacent tray being slid into the low stack orientation from the right side. In the low stack orientation, the adjacent tray is rotated 180° such that the rear block 22 of the adjacent tray is oriented on the left side, and the front block 20 of the adjacent tray is oriented on the right side as shown in FIG. 13. In this orientation, since the distance B over which the front recess is spaced from the front end 14 corresponds to the distance B from which the rear block 22 is spaced from the back end 16, in the low stack orientation, the rear block 22 engages the front recess 26 when the trays are nested. Similarly, the front block 20 of the adjacent tray engages the rear recess 28. As shown in the drawings, the trays are initially preliminarily aligned via the skirt 42 disposed inside the side walls 18. The rear block 22 initially is supported on the top rail 24 until the rear block 22 is seated in the front recess 26. Similarly, the front block 20 of the adjacent tray is seated in the rear recess 28 in the support space 40 defined by the vertical guide wall 38 (see FIG. 18). Because the footprint of the front block 20 is narrow enough to fit in the support space 40, in the low stack orientation, the front block 20 nests in the rear recess 28. The nested low stack position is shown in FIG. 17.

FIGS. 19-23 show an adjacent tray in the low stack orientation being slid in from the left in the drawing. In similar fashion, the skirt 42 provides initial alignment relative to the side walls 18, and the stacking blocks 20, 22 are supported on the top rail 24 of the bottom tray. The adjacent tray is slid to the right until the sliding blocks 20, 22 engage the respective recesses 28, 26 and the corner cutout 36 nests with the corner post 34. In the low stack orientation, the adjacent trays are closer to one another to minimize a stacking height for products with a lower profile.

Figure 26:
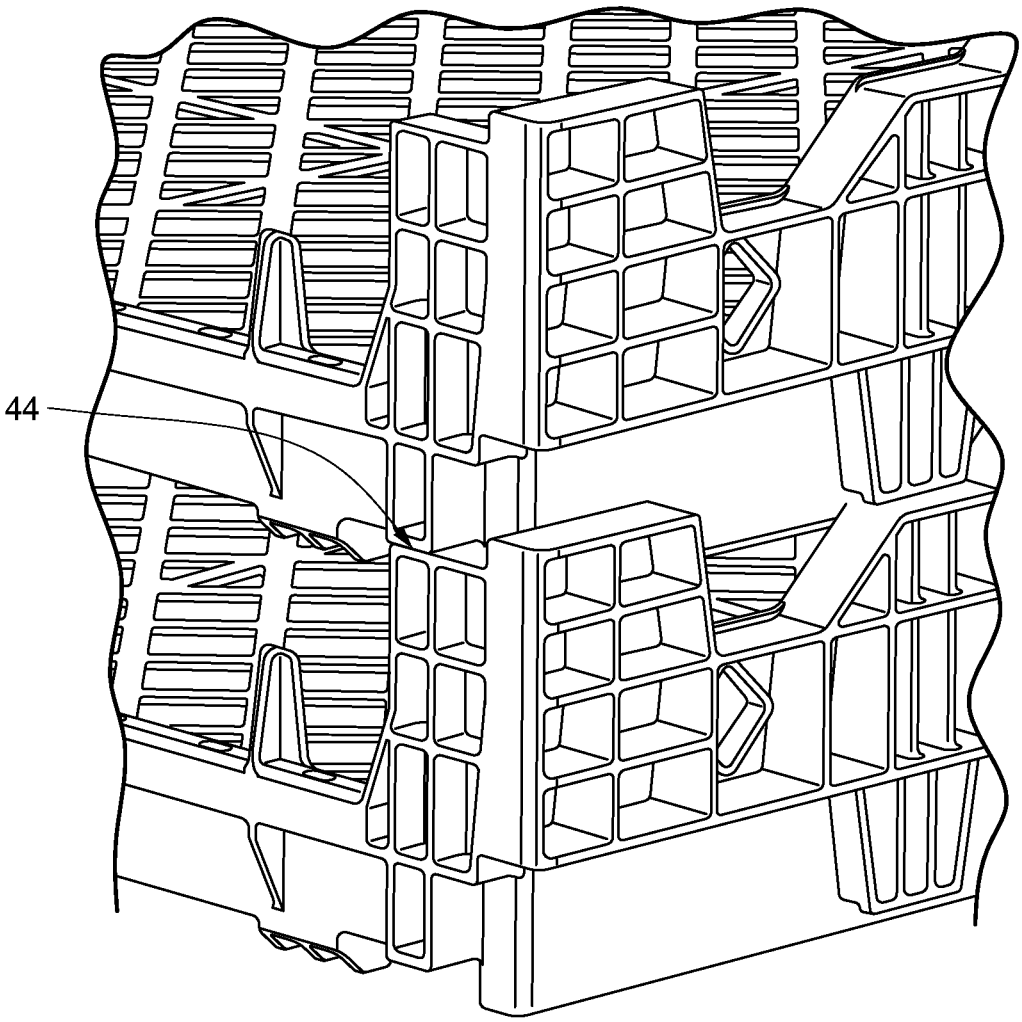

FIG. 26 shows a corner support 44 in the high stack orientation. The corner support 44 provides for better load distribution and stacking stability.

In any orientation, in order to destack a top tray, a front edge of the tray is lifted up above the corner post 34, and the tray is pulled off the stack. The slide walls 30, 32 are angled so that the stacking blocks 20, 22 are guided to the top rail 24 as the tray is pulled. The inclined surfaces are set at a shallow degree to the extent possible to provide for easy and smooth destacking.

The bakery tray according to preferred embodiments is stackable in two levels based on a relative orientation of adjacent trays. The trays are easily stacked and destacked, even in a "blind" stacking situation where the stack is higher than a stock person's shoulders.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A bakery tray comprising:

a base member including a front end and a back end; and a pair of sidewalls extending upward from the base member and opposing each other between the front end and the back end of the base member, the sidewalls each having a pair of stacking blocks and a top rail with a pair of low stack recesses therein, wherein the pair of stacking blocks includes a front block positioned a first distance from the front end and a rear block positioned a second distance from the back end, the second distance being different from the first distance, wherein the pair of low stack recesses includes a front recess spaced from the front end by a distance corresponding to the second distance and a rear recess spaced from the back end by a distance corresponding to the first distance, wherein the front recess comprises a first slide wall angled from a deepest point in the front recess to the top rail toward the back end, and wherein the rear recess comprises a second slide wall angled from a deepest point in the rear recess to the top rail toward the front end, the first and second slide walls being continuously angled or level from the deepest points in the front and rear recesses, respectively, to the top rail, wherein the bakery tray is configured such that the bakery tray is stackable on an adjacent bakery tray of identical construction, the stacking blocks, the top rail and the low stack recesses being configured such that the bakery tray is destacked from the adjacent bakery tray in both forward and rearward directions in only two actions including lifting an edge of the bakery tray and pulling the bakery tray, wherein each of the rear recesses comprises a vertical guide wall that defines respective support spaces for receiving stacking blocks of an adjacent bakery tray, and wherein the front blocks have a narrower footprint than the rear blocks such that the front blocks fit in the support spaces while the rear blocks are too big to fit in the support spaces.

2. A bakery tray according to claim 1, wherein each of the sidewalls comprises corner posts at respective ends of the top rails, and wherein bottom corners of the sidewalls comprise cutouts cooperable with the corner posts.

3. A bakery tray according to claim 1, wherein each of the first slide walls comprises two steps including the deepest point in the front recesses and a first inclined ramp to a landing portion as a first step, and a second inclined ramp from the landing portion to the top rail as a second step.

4. A bakery tray according to claim 3, wherein the landing portion is adjacent each of the front blocks.

5. A bakery tray according to claim 1, wherein the front blocks have a narrower footprint than the rear blocks.

6. A bakery tray according to claim 1, wherein the front recesses are open recesses with no sidewalls.

7. A bakery tray that is stackable on an adjacent bakery tray, the bakery tray comprising:

a base member including a front end and a back end; and a pair of sidewalls extending upward from the base member and opposing each other between the front end and the back end of the base member, the sidewalls each having a pair of stacking blocks and a top rail with a pair of low stack recesses therein, wherein the pair of stacking blocks includes a front block positioned a first distance from the front end and a rear block positioned a second distance from the back end, the second distance being different from the first distance, wherein an outermost surface of at least one of the stacking blocks extends to the top rail and is planar across an entire height of the stacking blocks, wherein the pair of low stack recesses includes a front recess spaced from the front end by a distance corresponding to the second distance and a rear recess spaced from the back end by a distance corresponding to the first distance, the bakery tray being configured such that the bakery tray is stackable on an adjacent bakery tray of identical construction, the bakery tray and the adjacent bakery tray being stackable in a high stack position and a low stack position, wherein in the high stack position, the front and rear blocks are stackable in alignment with corresponding front and rear blocks of the adjacent bakery tray, and in the low stack position, the front blocks are stackable in alignment with the rear recesses and the rear blocks are stackable in alignment with the front recesses, wherein the front recesses are open recesses without sidewalls, wherein the rear recesses comprise a vertical guide wall defining a support space for receiving stacking blocks of the adjacent bakery tray, and wherein the front blocks have a narrower footprint than the rear blocks such that the front blocks fit in the support spaces while the rear blocks are too big to fit in the support spaces.

8. A bakery tray according to claim 7, wherein the front blocks have a narrower footprint than the rear blocks.

9. A bakery tray according to claim 7, wherein in the high stack position, the bakery tray is oriented in alignment with the adjacent bakery tray, and wherein in the low stack position, the bakery tray is oriented 180° relative to the adjacent bakery tray.

10. A bakery tray according to claim 7, wherein each of the front recesses comprises a first slide wall angled from a deepest point in the front recesses to the top rail toward the back end, and wherein each of the rear recesses comprises a second slide wall angled from a deepest point in the rear recesses to the top rail toward the front end, the first and second slide walls being continuously angled or level from the deepest points in the front and rear recesses, respectively, to the top rail, and wherein the stacking blocks, the top rail and the low stack recesses are configured such that the bakery tray is destacked from the adjacent bakery tray in both forward and rearward directions in only two actions including lifting an edge of the bakery tray and pulling the bakery tray.

11. A bakery tray according to claim 7, wherein the outermost surface of one pair of the stacking blocks is planar across the entire height of the stacking blocks, and wherein the outermost surface of the other pair of stacking blocks is recessed.

* * * * *